US011783982B2

(12) United States Patent
Kim et al.

(10) Patent No.: US 11,783,982 B2
(45) Date of Patent: Oct. 10, 2023

(54) COIL COMPONENT

(71) Applicant: SAMSUNG ELECTRO-MECHANICS CO., LTD., Suwon-si (KR)

(72) Inventors: Hwi Dae Kim, Suwon-si (KR); Dong Hwan Lee, Suwon-si (KR); Sang Soo Park, Suwon-si (KR); Chan Yoon, Suwon-si (KR); Dong Jin Lee, Suwon-si (KR); Hye Mi Yoo, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 457 days.

(21) Appl. No.: 16/986,567

(22) Filed: Aug. 6, 2020

(65) Prior Publication Data

US 2021/0366640 A1 Nov. 25, 2021

(30) Foreign Application Priority Data

May 25, 2020 (KR) ..... 10-2020-0062334

(51) Int. Cl.

| | |
|---|---|
| ***H01F 17/00*** | (2006.01) |
| ***H01F 17/04*** | (2006.01) |
| ***H01F 27/29*** | (2006.01) |
| ***H01F 27/32*** | (2006.01) |

(52) U.S. Cl.

CPC ..... *H01F 17/0013* (2013.01); *H01F 17/04* (2013.01); *H01F 27/292* (2013.01); *H01F 27/324* (2013.01); *H01F 2017/048* (2013.01)

(58) Field of Classification Search

CPC .... H01F 17/0013; H01F 17/04; H01F 27/292; H01F 27/324; H01F 2017/048

See application file for complete search history.

(56) References Cited

U.S. PATENT DOCUMENTS

| | | | | |
|---|---|---|---|---|
| 2003/0085777 | A1* | 5/2003 | Kim | H01G 4/35 333/185 |
| 2004/0017280 | A1* | 1/2004 | Yamamoto | H01F 27/2804 336/84 R |
| 2004/0119573 | A1* | 6/2004 | Lee | H01F 19/04 336/200 |
| 2004/0135652 | A1* | 7/2004 | Uchida | H01F 17/0013 333/185 |

(Continued)

FOREIGN PATENT DOCUMENTS

| | | | |
|---|---|---|---|
| KR | 10-2014-0125709 | A | 10/2014 |
| KR | 10-2017-0026135 | A | 3/2017 |

(Continued)

*Primary Examiner* — Marlon T Fletcher
*Assistant Examiner* — Malcolm Barnes
(74) *Attorney, Agent, or Firm* — Morgan, Lewis & Bockius LLP

(57) ABSTRACT

A coil component includes a body; a coil portion disposed inside the body; a noise removal portion disposed to contact a surface of the body; an insulating layer disposed inside the noise removal portion; first and second external electrodes each connected to the coil portion and disposed on the insulating layer to overlap the noise removal portion; and a third external electrode disposed to be spaced apart from the first and second external electrodes and contacting the noise removal portion.

18 Claims, 13 Drawing Sheets

(56) References Cited

U.S. PATENT DOCUMENTS

| | | | | |
|---|---|---|---|---|
| 2004/0207488 | A1* | 10/2004 | Kono | H03H 1/0007 333/185 |
| 2009/0051474 | A1* | 2/2009 | Lee | H01F 17/04 336/83 |
| 2011/0309895 | A1* | 12/2011 | Ahn | H03H 7/01 333/185 |
| 2014/0313785 | A1* | 10/2014 | Lee | H01F 17/0013 363/21.01 |
| 2015/0130580 | A1* | 5/2015 | Lee | H01F 27/29 336/200 |
| 2017/0063322 | A1* | 3/2017 | Matsunaga | H01F 27/292 |
| 2017/0169930 | A1* | 6/2017 | Kudo | H01F 17/0013 |
| 2017/0169933 | A1* | 6/2017 | Kim | H01F 17/04 |
| 2017/0372833 | A1* | 12/2017 | Jang | H01F 17/04 |
| 2020/0082975 | A1 | 3/2020 | Yang et al. | |

FOREIGN PATENT DOCUMENTS

| | | | | |
|---|---|---|---|---|
| KR | 20180005942 | A | * | 1/2018 |
| KR | 10-2069635 | B1 | | 2/2020 |

* cited by examiner

COIL COMPONENT

CROSS-REFERENCE TO RELATED APPLICATION(S)

The present application claims the benefit of priority to Korean Patent Application No. 10-2020-0062334 filed on May 25, 2020 in the Korean Intellectual Property Office, the disclosure of which is incorporated herein by reference in its entirety.

TECHNICAL FIELD

The present disclosure relates to a coil component.

BACKGROUND

An inductor, a coil component, is a typical passive electronic component used in electronic devices, along with a resistor and a capacitor.

As electronic devices gradually become high-performance and smaller, the number of electronic components used in such electronic devices may increase, the electronic components may be miniaturized, and an operating frequency of the electronic components may increase.

For these reasons, there is an increased possibility of problems due to relatively high frequency noise in the coil components.

SUMMARY

An aspect of the present disclosure is to provide a coil component capable of easily removing high frequency noise.

According to an aspect of the present disclosure, a coil component includes a body; a coil portion disposed inside the body; a noise removal portion disposed to contact a surface of the body; an insulating layer disposed inside the noise removal portion; first and second external electrodes each connected to the coil portion and disposed on the insulating layer to overlap the noise removal portion; and a third external electrode disposed to be spaced apart from the first and second external electrodes and contacting the noise removal portion.

According to another aspect of the present disclosure, a coil component may include a body; a coil portion disposed inside the body; a noise removal portion disposed on a surface of the body in a first direction and contacting said surface; an insulating layer disposed on the noise removal portion in the first direction; first and second external electrodes respectively connected to opposing ends of the coil portion; and a third external electrode disposed to be spaced apart from the first and second external electrodes and contacting the noise removal portion. The insulating layer may be arranged between the noise removal portion and each of the first and second external electrodes in the first direction.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
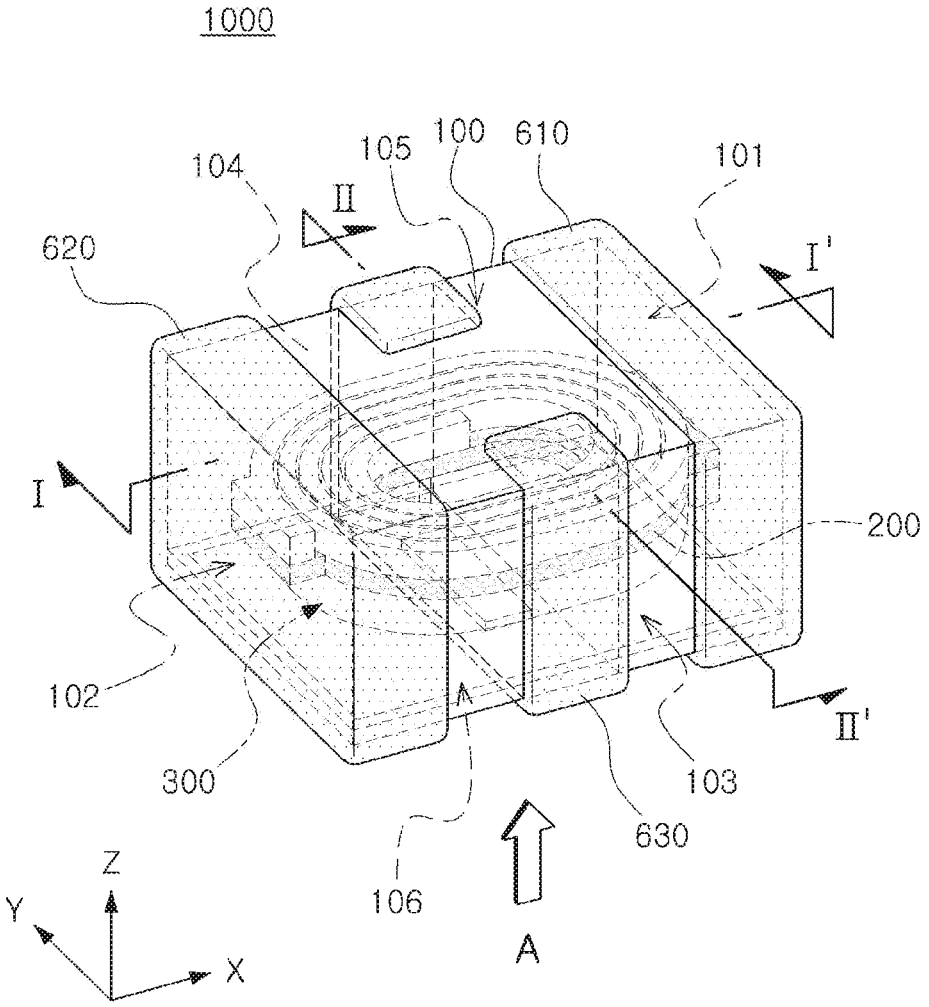
FIG. 1 is a view schematically illustrating a coil component according to a first embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term. "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an X direction is a first direction, or a length (longitudinal) direction of a body, a Y direction is a second direction, or a width direction of the body, a Z direction is a third direction, or a thickness direction of the body.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment & Modified Example

Figure 2:
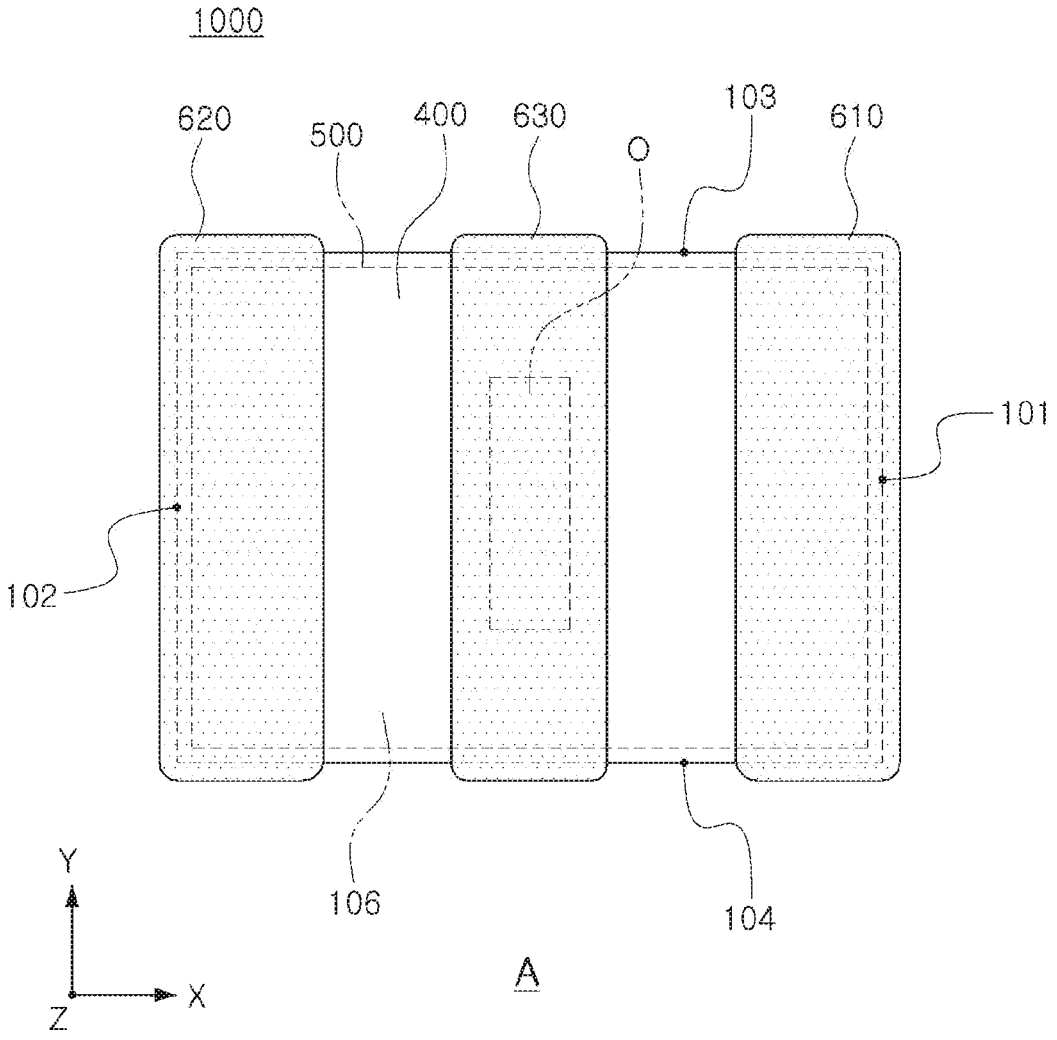
FIG. 2 is a schematic view of FIG. 1, when viewed in direction A.
Figure 3:
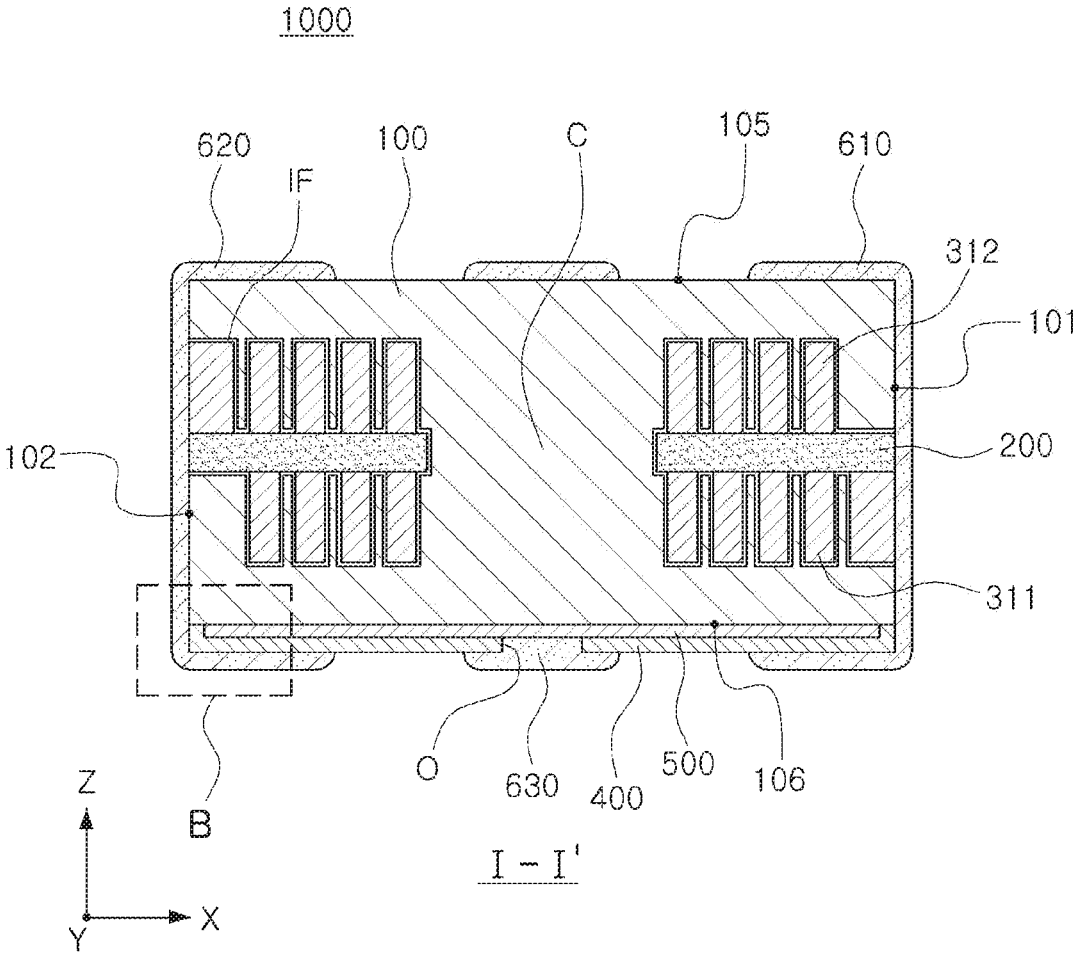
FIG. 3 is a view illustrating a cross-section taken along line I-I' of FIG. 1.
Figure 4:
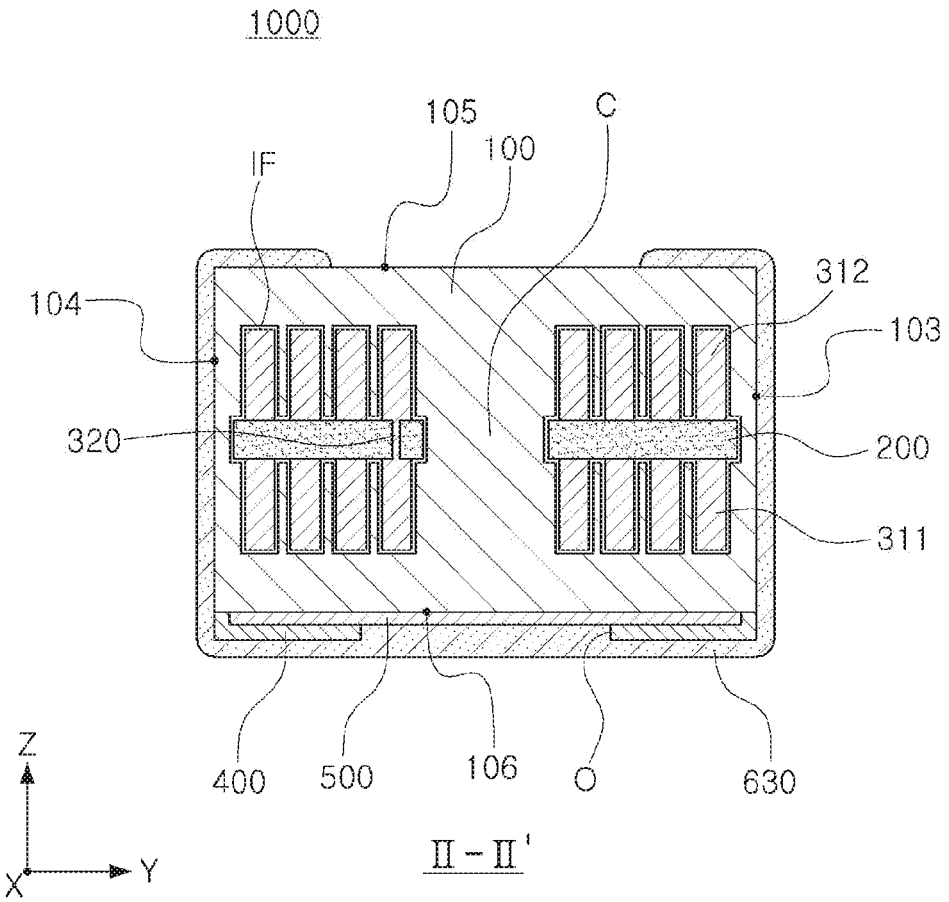
FIG. 4 is a view illustrating a cross-section taken along line II-II' of FIG. 1.
Figure 5:
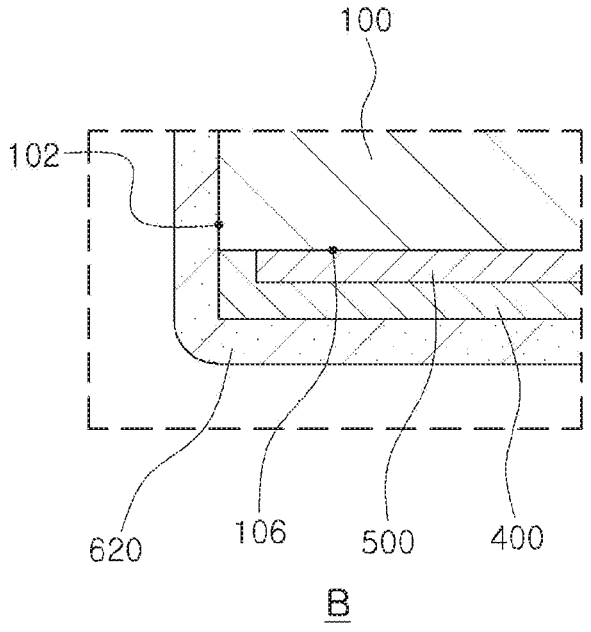
FIG. 5 is an enlarged view of portion B of FIG. 3.
Figure 6:
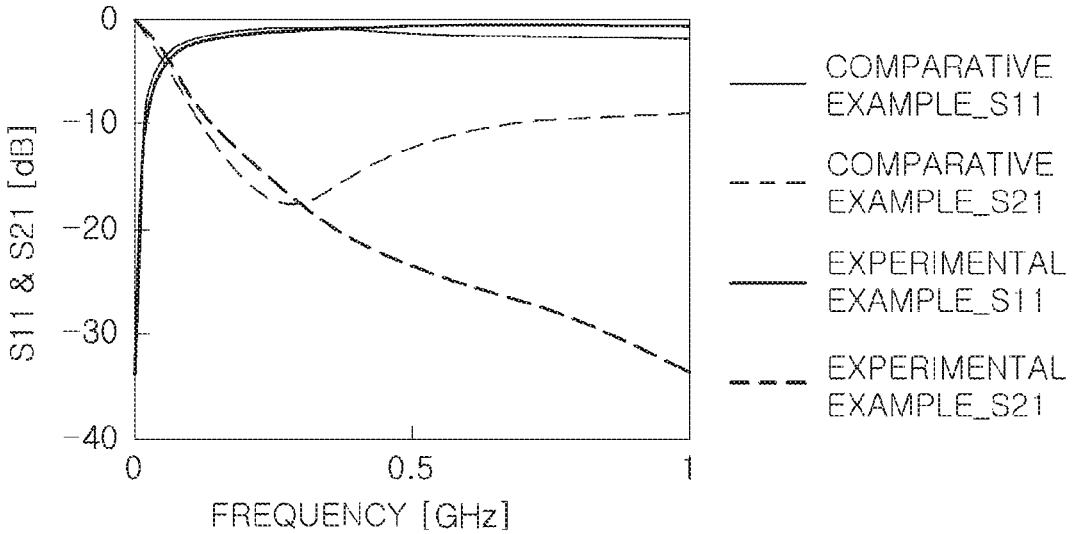
FIG. 6 is a view illustrating a signal transmission characteristic (an S-parameter) of each of the Experimental Example and Comparative Example.

FIG. 1 is a view schematically illustrating a coil component according to a first embodiment of the present disclosure. FIG. 2 is a schematic view of FIG. 1, when viewed in direction A. FIG. 3 is a view illustrating a cross-section taken along line I-I' of FIG. 1. FIG. 4 is a view illustrating a cross-section taken along line II-II' of FIG. 1. FIG. 5 is an enlarged view of portion B of FIG. 3. FIG. 6 is a view illustrating a signal transmission characteristic (an S-parameter) of each of the Experimental Example and the Comparative Example.

Referring to FIGS. 1 to 5, a coil component 1000 according to a first embodiment of the present disclosure may include a body 100, a support substrate 200, a coil portion 300, an insulating layer 400, a noise removal portion 500, and first to third external electrodes 610, 620, and 630.

The body 100 may form an exterior of the coil component 1000 according to this embodiment, and the coil portion 300 may be embedded therein.

The body 100 may be formed to have a hexahedral shape overall.

Referring to FIG. 1, the body 100 may include a first surface 101 and a second surface 102 opposing each other in a length direction X of the body 100, a third surface 103 and a fourth surface 104 opposing each other in a width direction Y of the body 100, and a fifth surface 105 and a sixth surface 106 opposing each other in a thickness direction Z of the body 100. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body 100, and both side surfaces of the body 100 may refer to the third surface 103 and the fourth surface 104 of the body 100. In addition, one surface and the other surface of the body 100 may refer to the sixth surface 106 and the fifth surface 105 of the body 100, respectively.

The body 100 may, for example, be formed such that the coil component 1000 according to this embodiment in which the first to third external electrodes 610, 620, and 630 to be described later are formed has a length of 2.0 mm, a width of 1.2 mm, and a thickness of 0.65 mm, but is not limited thereto. Since the above-described numerical values are only design values that do not reflect process errors and the like, it should be considered that they fall within the scope of the present disclosure, to the extent that they are recognized as process errors.

The length, the width, and the thickness of the coil components 1000 described above may be measured by a micrometer measurement method, respectively. The micrometer measurement method may be carried out by setting a zero point with a micrometer (apparatus) having a Gage R&R technique (i.e., a gage repeatability and reproducibility technique), inserting the coil component 1000 between tips of the micrometer, and turning a measuring dial of the micrometer. In measuring the length of the coil component 1000 by the micrometer measurement method, the length of the coil component 1000 may refer to a value measured once, or may refer to an arithmetic mean of values measured multiple times. This may be equally applied to the width and the thickness of the coil component 1000.

The length, the width, and the thickness of the coil component 1000 described above may be measured by a cross-section analysis method, respectively. As an example, a method for measuring the length of the coil component 1000 by the cross-section analysis method will be described. Based on a image for a cross-section of a central portion of the body 100 in the width direction Y, in the longitudinal direction X-thickness direction Z, captured by an optical microscope or a scanning electron microscope (SEM), the length of the coil component 1000 may refer to a maximum value among lengths of a plurality of line segments, connecting outermost boundary lines of the coil component 1000, and parallel to the longitudinal direction X of the body 100, as shown in the captured image. Alternatively, the length of the coil component 1000 may refer to a minimum value among lengths of a plurality of line segments, connecting outermost boundary lines of the coil component 1000, and parallel to the longitudinal direction X of the body 100, as shown in the captured image. Alternatively, the length of the coil component 1000 may refer to an arithmetic mean value of at least three or more lengths of a plurality of line segments, connecting outermost boundary lines of the coil component 1000, and parallel to the longitudinal direction X of the body 100, as shown in the captured image. This may be equally applied to the width and the thickness of the coil component 1000.

The body 100 may include a magnetic material and a resin. Specifically, the body 100 may be formed by stacking one or more magnetic composite sheets including a resin and a magnetic material dispersed in the resin. The body 100 may have a structure, other than a structure in which the magnetic material may be dispersed in the resin. For example, the body 100 may be formed of a magnetic material such as ferrite.

The magnetic material may be a ferrite powder particle or a metal magnetic powder particle.

Example of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder particle may be amorphous or crystalline. For example, the metal magnetic powder particle may be a Fe—Si—B—Cr-based amorphous alloy powder particle, but is not limited thereto.

The ferrite powder particle and the magnetic powder particle may each have an average diameter of about 0.1 μm to 30 μm, but are not limited thereto. In this case, the average diameter may refer to a particle size distribution represented by D50 or D90.

The body 100 may include two or more types of magnetic materials dispersed in resin. In this case, the term "different types of magnetic materials" means that the magnetic materials dispersed in the resin are distinguished from each other by diameter, composition, crystallinity, and a shape.

The resin may include an epoxy, a polyimide, a liquid crystal polymer, or the like, in a single form or in combined forms, but is not limited thereto.

The body 100 may include a core C passing through a central portion of each of the support substrate 200 and the coil portion 300, which will be described later. The core C may be formed by filling a through-hole of the coil portion 300 with a magnetic composite sheet, but is not limited thereto.

The support substrate 200 may be embedded in the body 100. The support substrate 200 may support the coil portion 300 to be described later.

The support substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the support substrate 200 may be formed of a material such as prepreg, Ajinomoto Build-up Film (ABF), FR-4, a bismaleimide triazine (BT) resin, a photoimageable dielectric (PID), a copper clad laminate (CCL), and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide better rigidity. When the support substrate 200 is formed of an insulating material not containing glass fibers, the support substrate 200 may be advantageous for reducing a thickness of the overall coil portion 300. When the support substrate 200 is formed of an insulating material containing a photosensitive insulating resin, the number of processes for forming the coil portion 300 may be reduced. Therefore, it may be advantageous in reducing production costs, and a fine via may be formed.

The coil portion 300 may be embedded in the body 100, and may manifest characteristics of the coil component. For example, when the coil component 1000 of this embodiment is used as a power inductor, the coil portion 300 may function to stabilize the power supply of an electronic device by storing an electric field as a magnetic field and maintaining an output voltage.

The coil portion 300 may be formed on at least one of both surfaces of the support substrate 200, and may format least one turn. In this embodiment, the coil portion 300 may include first and second coil patterns 311 and 312, formed on both surfaces of the support substrate 200, opposing each other, in the thickness direction Z of the body 100, and a via 320 passing through the support substrate 200 to connect the first and second coil patterns 311 and 312 to each other.

Each of the first coil pattern 311 and the second coil pattern 312 may be in the form of a planar spiral shape having at least one turn formed about the core C. For example, based on the directions of FIGS. 3 and 4, the first coil pattern 311 may format least one turn around the core C on a lower surface of the support substrate 200, and the second coil pattern 312 may format least one turn around the core C on an upper surface of the support substrate 200.

End portions of the first and second coil patterns 311 and 312 may be connected to the first and second external electrodes 610 and 620, respectively, which will be described later. For example, the end portion of the first coil pattern 311 may extend to be exposed from the first surface 101 of the body 100, and the end portion of the second coil pattern 312 may extend to be exposed from the second surface 102 of the body 100, to be connected to the first and second external electrodes 610 and 620, formed on the first and second surfaces 101 and 102 of the body 100, respectively.

At least one of the coil patterns 311 and 312 and the via 320 may include at least one conductive layer. For example, when the second coil pattern 312 and the via 320 are formed by plating on the other surface of the support substrate 200, the second coil pattern 312 and the via 320 may include a seed layer and an electroplating layer, respectively. The seed layer may be formed by a vapor deposition method such as electroless plating, sputtering, or the like. Each of the seed layer and the electroplating layer may have a single-layer structure or a multilayer structure. The electroplating layer of the multilayer structure may be formed by a conformal film structure in which one electroplating layer is covered by the other electroplating layer, or may have a form in which the other electroplating layer is stacked on only one surface of the one electroplating layer. The seed layer of the second coil pattern 312 and the seed layer of the via 320 may be integrally formed, no boundary therebetween may occur, but are not limited thereto. The electroplating layer of the second coil pattern 312 and the electroplating layer of the via 320 may be integrally formed, no boundary therebetween may occur, but are not limited thereto.

As another example, based on the directions of FIGS. 3 and 4, when the first coil pattern 311 disposed on the lower surface side of the support substrate 200 and the second coil pattern 312 disposed on the upper surface side of the support substrate 200 are formed separately, and then collectively stacked on the support substrate 200 to form the coil portion 300, the via 320 may include a high-melting-point metal layer, and a low-melting-point metal layer having a melting point lower than a melting point of the high-melting-point metal layer. In this case, the low-melting-point metal layer may be formed of a solder containing lead (Pb) and/or tin (Sn). At least a portion of the low-melting-point metal layer may be melted due to pressure and temperature during batch stacking. For this reason, an intermetallic compound layer (IMC layer) may be formed on at least a portion of a boundary between the low-melting-point metal layer and the second coil pattern 312 and a boundary between the low-melting-metal layer and the high-melting-point metal layer.

The coil patterns 311 and 312 may be formed to protrude from the lower surface and the upper surface of the support substrate 200, respectively, based on the directions of FIGS. 3 and 4. As another example, based on the directions of FIGS. 3 and 4, the first coil pattern 311 may be formed to protrude from the lower surface of the support substrate 200, and the second coil pattern 312 may be formed to be embedded in the support substrate 200, but may have an upper surface protruding from the upper surface of the support substrate 200. In this case, a recess may be formed in the upper surface of the second coil pattern 312, such that the upper surface of the support substrate 200 and the upper surface of the second coil pattern 312 may not be located on the same plane. As another example, based on the directions of FIGS. 3 and 4, the second coil pattern 312 may be formed to protrude from the upper surface of the support substrate 200, and the first coil pattern 311 may be formed to be embedded in the lower surface of the support substrate 200, but may have a lower surface protruding from the lower surface of the support substrate 200. In this case, a recess may be formed in the lower surface of the second coil pattern 312, such that the lower surface of the support substrate 200 and the lower surface of the second coil pattern 312 may not be located on the same plane.

Each of the coil patterns 311 and 312, and the via 320 may be formed of a conductive material such as copper (Cu), aluminum (Al), silver (Ag), tin (Sn), gold (Au), nickel (Ni), lead (Pb), titanium (Ti), chromium (Cr), or alloys thereof, but is not limited thereto.

An insulating film IF may be disposed between each of the first coil pattern 311 and the second coil pattern 312 and the body 100. For example, referring to FIGS. 3 and 4, the insulating film IF may be formed as a conformal film along the surfaces of the first coil pattern 311, the support substrate 200, and the second coil pattern 312. The insulating film IF may protect each of the coil patterns 311 and 312, may insulate the coil patterns 311 and 312 from the body 100, and may include a known insulating material such as parylene or the like. Any insulating material included in the insulating film IF may be used, and there is no particular limitation. The insulating film IF may be formed by vapor deposition or the like, but is not limited thereto, and may be formed by stacking an insulating material such as Ajinomoto Build-up Film (ABF) or the like on the support substrate 200.

The insulating layer 400 may be disposed between the noise removal portion 500 to be described later and the first and second external electrodes 610 and 620. In this embodiment, since the noise removal portion 500 is disposed on the sixth surface 106 of the body 100, the insulating layer 400 may be disposed on the sixth surface 106 of the body 100.

The insulating layer 400 may be formed by stacking an insulating film on the sixth surface 106 of the body 100 on which the noise removal portion 500 to be described later is formed. The insulating film may be a conventional non-photosensitive insulating film such as Ajinomoto Build-up Film (ABF), prepreg, or the like, or a dry-film or a photosensitive insulating film such as a photoimageable dielectric (PID). The insulating layer 400 may function as a dielectric layer, because the first and second external electrodes 610 and 620 and the noise removal portion 500 may be capacitively-coupled. This will be described later in detail.

The noise removal portion 500 may be disposed on the surface of the body 100, to discharge high frequency noise generated from the coil component 1000 according to this embodiment and/or high frequency noise transmitted to the coil component 1000 according to this embodiment, to the outside of the coil component 1000 such as a mounting substrate. Specifically, the noise removal portion 500 may be capacitively-coupled to each of the first and second external electrodes 610 and 620, to remove high frequency noise from an input signal transmitted to the coil component 1000 according to this embodiment and an output signal transmitted externally from the coil component 1000 according to this embodiment. This will be described later in detail. In this case, the term "high frequency noise" may refer to a signal having a frequency exceeding an upper limit of a frequency range set as an operating frequency, when designing the coil component 1000 according to this embodiment. As a non-limiting example, in this embodiment, high frequency noise may refer to a signal of 600 MHz or more.

The noise removal portion 500 may include a conductor. For example, the noise removal portion 500 may be formed of a conductive material such as copper (Cu), aluminum (Al), silver (Ag), tin (Sn), gold (Au), nickel (Ni), lead (Pb), titanium (Ti), chromium (Cr), or alloys thereof, but is not limited thereto. The noise removal portion 500 may be formed by stacking a metal film such as a copper film on the sixth surface of the body 100, but is not limited thereto.

The first and second external electrodes 610 and 620 may be connected to the coil portion 300. In this embodiment, the first external electrode 610 may be disposed on the first surface 101 of the body 100, may be in contact with and be connected to an end portion of the first coil pattern 311, exposed from the first surface 101 of the body 100, and may extend to a portion of each of the third to sixth surfaces 103, 104, 105, and 106 of the body 100. The second external electrode 620 may be disposed on the second surface 102 of the body 100, may be in contact with and be connected to an end portion of the second coil pattern 312, exposed from the second surface 102 of the body 100, and may extend to a portion of each of the third to sixth surfaces 103, 104, 105, and 106 of the body 100. In each of the third to sixth surfaces 103, 104, 105, and 106 of the body 100, the first and second external electrodes 610 and 620 may be arranged to be spaced apart from each other.

Each of the first and second external electrodes 610 and 620 may extend to a portion of the sixth surface 106 of the body 100 to overlap the noise removal portion 500. The first and second external electrodes 610 and 620 may be input/output electrodes electrically connecting the coil component 1000 to a mounting substrate, when the coil component 1000 according to this embodiment is mounted on the mounting substrate. In this embodiment, the noise removal portion 500, which may be conductors, and the first and second external electrodes 610 and 620, which may be conductors, may be arranged to overlap each other. The insulating layer 400, which may be a dielectric, may be disposed between each of the noise removal portion 500 and the first and second external electrodes 610 and 620, such that each of the noise removal portion 500 and the first and second external electrodes 610 and 620 may be capacitively-coupled. For example, each of the noise removal portion 500 and the first and second external electrodes 610 and 620 may form capacitance by the insulating layer 400. The high frequency noise transmitted to each of the first and second external electrodes 610 and 620 may be transmitted to the noise removal portion 500 due to the above-described capacitive-coupling. The noise removal portion 500 may be connected to the third external electrode 630 to be described later, and the third external electrode 630 may be connected to a ground, such as a mounting substrate, to remove high frequency noise to a mounting substrate or the like. An overlapping area between each of the noise removal portion 500 and the first and second external electrodes 610 and 620, a dielectric constant of the insulating layer 400, and a thickness of the insulating layer 400, respectively, may be changed in an appropriate manner, considering a frequency range of high frequency noise to be removed.

The third external electrodes 630 may be disposed to be spaced apart from the first and second external electrodes 610 and 620, and may be in contact with and connected to the noise removal portion 500. The third external electrode 630 may be connected to a ground of amounting substrate, when the coil component 1000 according to this embodiment is mounted on the mounting substrate or the like, or may be connected to a ground of a electronic component package, when the coil component 1000 according to this embodiment is packaged in the electronic component package. The third external electrode 630 may be a ground electrode of the coil component 1000 according to this embodiment.

In the case of this embodiment, the third external electrode 630 may be formed on the third to sixth surfaces 103, 104, 105, and 106 of the body 100, but may be formed to have an entirely rectangular cross-section from which a portion of an upper side is removed. For the reasons, the third external electrode 630 may be disposed to be spaced apart from the first and second external electrodes 610 and 620 on the third to sixth surfaces 103, 104, 105, and 106 of the body 100.

The third external electrode 630 may penetrate through the insulating layer 400 to contact and connected to the noise removal portion 500. For example, referring to FIGS. 2 and 3, a protrusion may be formed in one region of the third external electrode 630 disposed on the sixth surface 106 of the body 100, and the protrusion may penetrate through a portion of the insulating layer 400, to contact and connect the third external electrode 630 and the noise removal portion 500. Therefore, an opening O corresponding to the protrusion may be formed in the insulating layer 400. As another example, based on the direction of FIG. 2, a slit extending from a lower edge of the sixth surface 106 of the body 100 to an upper edge of the sixth surface 106 of the body 100 may be formed on the insulating layer 400, and the third external electrode 630 may be in contact with and connected to the noise removal portion 500 by the slit. In this case, a width of the slit may be equal to a line width of a region of the third external electrodes 630 (a distance of the pattern portion 310 in the X direction in FIG. 2), disposed on the sixth surface 106 of the body 100, but is not limited thereto.

Each of the first to third external electrodes 610, 620, and 630 may include at least one of a conductive resin layer and an electrolytic plating layer. The conductive resin layer may be formed by printing a conductive paste on a surface of the body 100 and curing the printed conductive paste, and may include any one or more conductive metals selected from the group consisting of copper (Cu), nickel (Ni), and silver (Ag), and a thermosetting resin. The electrolytic plating layer may include any one or more selected from the group consisting of nickel (Ni), copper (Cu), and tin (Sn).

Referring to FIGS. 3 to 5, the noise removal portion 500 may be disposed to contact the sixth surface 106 of the body 100. Since the noise removal portion 500 is disposed on the sixth surface 106 of the body 100, high frequency noise may be discharged to an outside of the component relatively quickly. For example, since the noise removal portion 500 is disposed on the sixth surface 106 of the body 100, capacitance for removing high frequency noise may be formed in a position relatively close to the mounting substrate, to shorten a path for removing high frequency noise. In addition, since the noise removal portion 500 is disposed between the body 100 and the mounting substrate, magnetic flux formed by the coil portion 300 may reduce noise caused by circuit patterns of the mounting substrate and the like. In addition, the noise removal portion 500 may be disposed to contact the sixth surface 106 of the body 100, to minimize an increase in thickness of the entire component due to formation of the noise removal portion 500. In addition, the noise removal portion 500 may be disposed to contact the sixth surface 106 of the body 100, to minimize a distance between the coil portion 300 and the noise removal portion 500, arranged opposing each other via the body 100 having a dielectric constant other than zero, and to form a capacitive-coupling between the coil portion 300 and the noise removal portions 500 to remove high frequency noise.

The noise removal portion 500 may be disposed to be spaced apart from an edge in which the one surface of the body 100 meets each of both end surfaces of the body 100 and the both side surfaces of the body 100. For example, referring to FIG. 2, the noise removal portion 500 may be disposed on the sixth surface 106 of the body 100, but may not extend to edges in which the sixth surface 106 of the body 100 meets the first to fourth surfaces 101, 102, 103, and 104 of the body 100. For this reason, side surfaces of the noise removal portion 500 may be arranged to have a separation space spaced apart from the above-described edges. The insulating layer 400 may be disposed inside the separation space, and the insulating layer 400 may cover the side surfaces of the noise removal portion 500. According to the above-described structure, the noise removal portion 500 may be spaced from edges in which the sixth surface 106 of the body 100 meets the first and second surfaces 101 and 102 of the body 100. Therefore, the first and second external electrodes 610 and 620 may be prevented from being short-circuited by each other due to the noise removal portion 500. Conductive metal magnetic powder particles may be exposed from the edges of the sixth surface 106 of the body 100, due to concentration of stress. According to the above-described structure, the first and second external electrodes 610 and 620 may be prevented from being short-circuited due to the noise removal portion 500 and the metal magnetic powder exposed around the edges.

FIG. 6 is a view illustrating a signal transmission characteristic (an S-parameter) of each of the Experimental Example and the Comparative Example.

The Comparative Example is a coil component that does not include the noise removal portion 500 described above, and the Experimental Example is a coil component that includes the noise removal portion 500 described above. In Comparative Example and Experimental Example, all conditions were the same, except for the presence or absence of the above-described noise removal portion 500. For example, in Comparative Example and Experimental Example, the number of turns of the coil portion, a diameter of a metal wire constituting the coil portion, and a size of a body may all be the same. In Comparative Example and Experimental Example, a signal transmission characteristic (S21) between ports was confirmed through a 3D EM Simulator HFSS using a first external electrode as an input terminal and a second external electrode as an output terminal. In the Comparative Example and the Experimental Example, signal transmission characteristics (S21) at frequencies of 600 MHz, 800 MHz, and 1 GHz were confirmed. In summary, the results therefrom were illustrated in Table 1 below.

TABLE 1

| Frequency | S21(@600 MHz) | S21(@800 MHz) | S21(@1 GHz) |
|---|---|---|---|
| Comparative Example | −10.817 | −9.402 | −9.142 |
| Experimental Example | −25.478 | −28.925 | −33.542 |
| (Amount in Change) | (14.66) | (19.52) | (24.4) |

Referring to FIG. 6 and Table 1, it can be seen that a high frequency signal was more easily removed in the Experimental Example than in the Comparative Example. For example, it can be seen that Comparative Example in which the noise removal portion was not formed passed a relatively high frequency signal. This means that a high frequency signal may be relatively well transmitted from an input terminal to an output terminal, and means that an effect of removing high frequency noise may be negligible. It can be seen that Experimental Example in which the noise removal portion was formed did not pass a relatively high frequency signal well. As a result, it can be seen that when comparing Experimental Example and Comparative Example, Experimental Example effectively prevented unnecessary high frequency noise.

Figure 7:
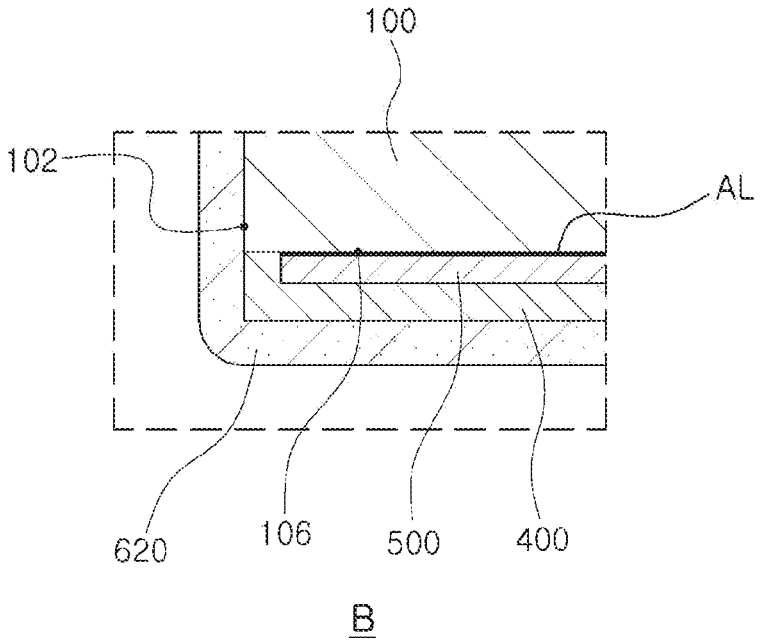
FIG. 7 is a view schematically illustrating a first modified example of a first embodiment of the present disclosure, and corresponding to FIG. 5.

FIG. 7 is a view schematically illustrating a first modified example of a first embodiment of the present disclosure, corresponding to FIG. 5.

Referring to FIGS. 5 and 7, in a case of the first embodiment, a adhesive layer AL disposed between the sixth surface 106 of the body 100 and the noise removal portion 500 may be further included. The noise removal portion 500 may be disposed on the sixth surface 106 of the body 100. Since the body 100 including an insulating resin and the noise removal portion 500 including a conductor may be heterogeneous materials, bonding strength therebetween may be relatively weak. In this modified example, the noise removal portion 500 may be prevented from being peeled off by disposing the adhesive layer AL between the noise removal portion 500 and the sixth surface 106 of the body 100. The adhesive layer AL and the noise removal portion 500 may be formed by stacking a material such as resin coated copper (RCC) on the sixth surface 106 of the body 100, but is not limited thereto. The adhesive layer AL may include a thermosetting resin such as an epoxy resin, but is not limited thereto.

Figure 8:
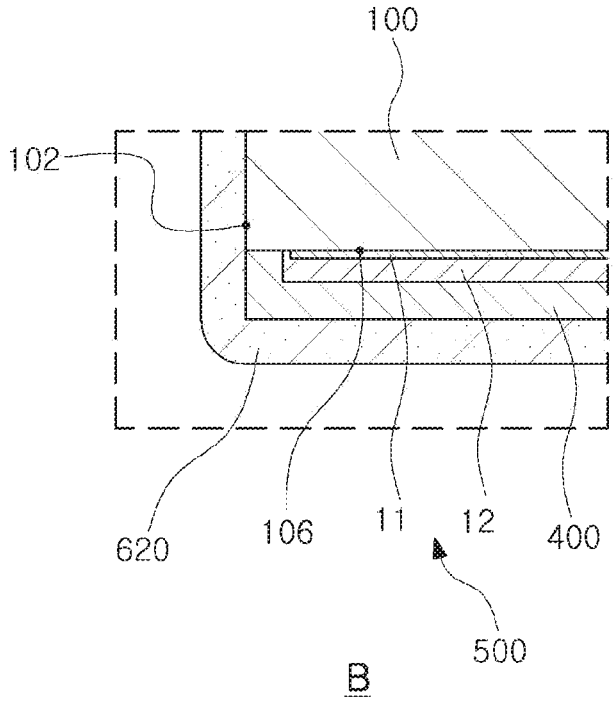
FIG. 8 is a view schematically illustrating a second modified example of a first embodiment of the present disclosure, and corresponding to FIG. 5.

FIG. 8 is a view schematically illustrating a second modified example of a first embodiment of the present disclosure, corresponding to FIG. 5.

Referring to FIGS. 5 and 8, in the first embodiment, the noise removal portion 500 may include a first conductive layer 11, and a second conductive layer 12 disposed on the first conductive layer 11. The first conductive layer 11 may be a seed layer for forming the second conductive layer 12 by an electroplating process, and the second conductive layer 12 may be an electrolytic plating layer formed by plating the first conductive layer 11 as a seed layer on the sixth surface 106 of the body 100. The first conductive layer 11 may be formed by a vapor deposition process such as a sputtering process or an electroless plating process. Each of the first conductive layer 11 and the second conductive layer 12 may be formed of a conductive material such as copper (Cu), aluminum (Al), silver (Ag), tin (Sn), gold (Au), nickel (Ni), lead (Pb), titanium (Ti), or alloys thereof, but is not limited thereto. FIG. 8 illustrates that the second conductive layer 12 is plated to cover side surfaces of the first conductive layer 11, but is not limited thereto. As another example, unlike FIG. 8, when a plating resist is used to form the second conductive layer 12, the second conductive layer 12 may not cover the side surfaces of the first conductive layer 11.

Figure 9:
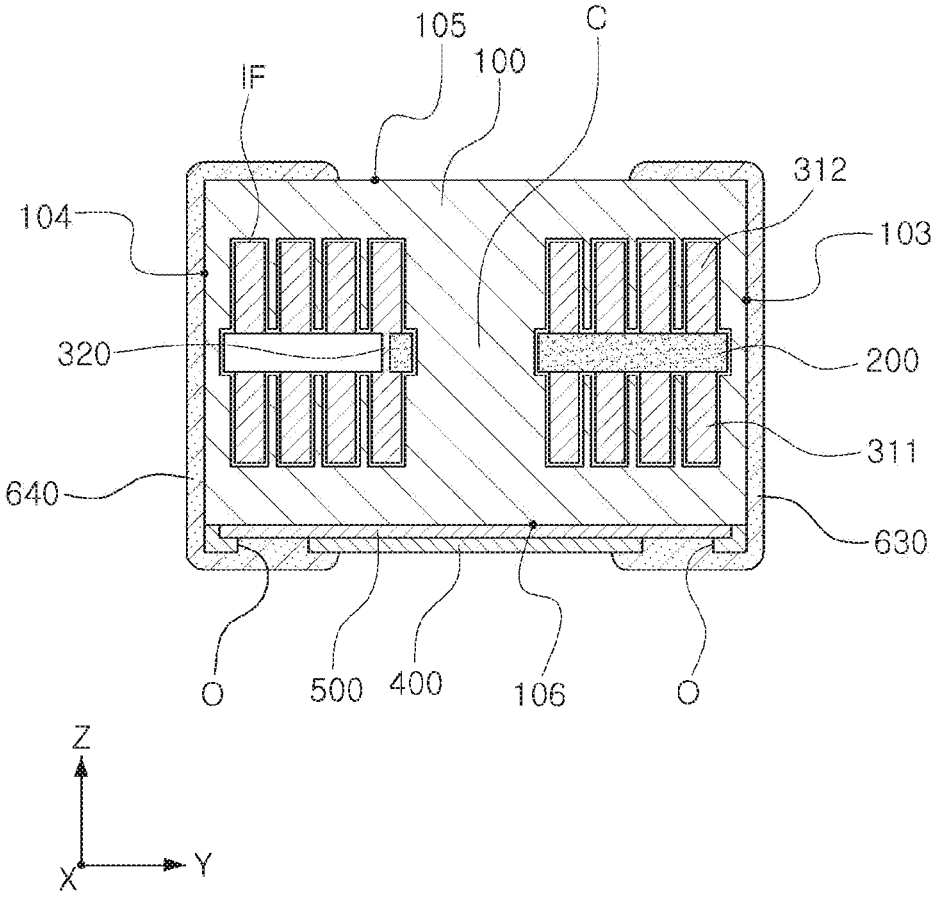
FIG. 9 is a view schematically illustrating a third modified example of a first embodiment of the present disclosure, and corresponding to FIG. 4.
Figure 10:
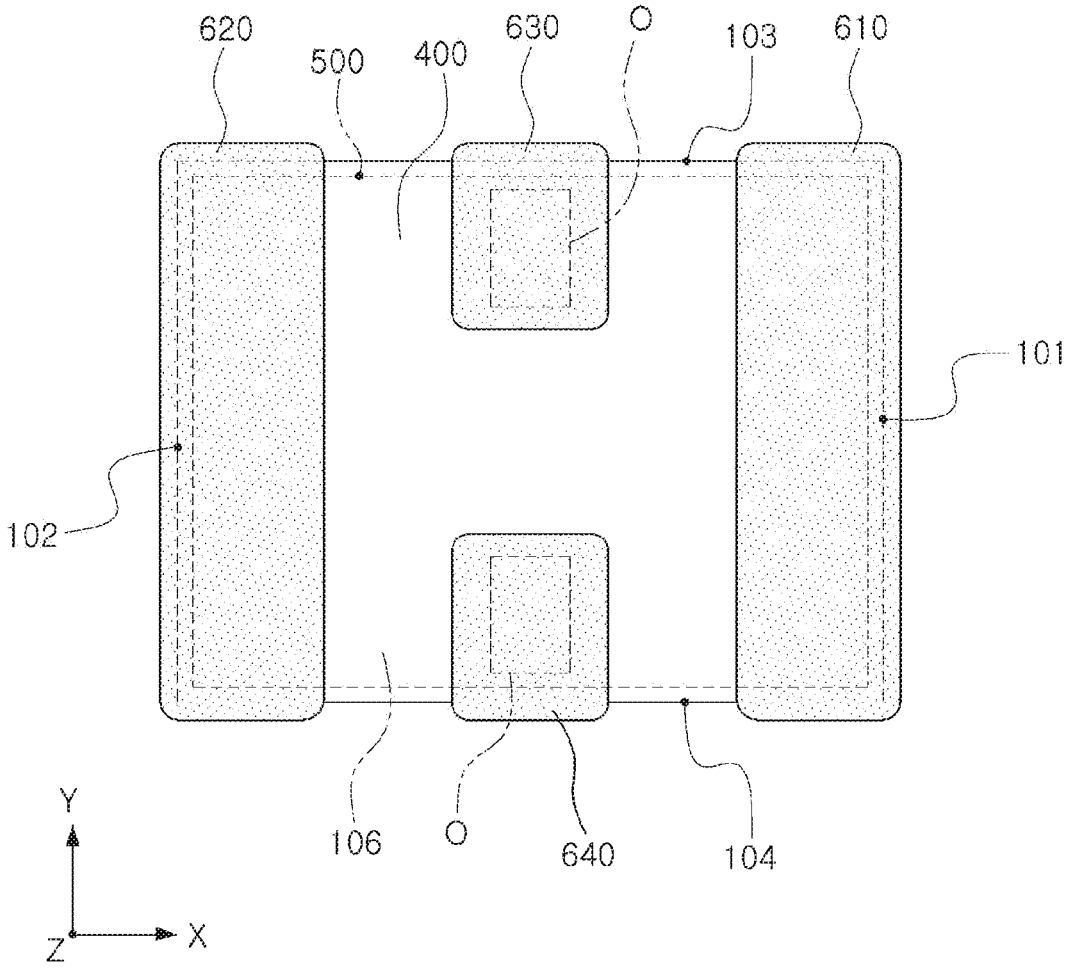
FIG. 10 is a view schematically illustrating a third modified example of a first embodiment of the present disclosure, and corresponding to FIG. 2.

FIG. 9 is a view schematically illustrating a third modified example of a first embodiment of the present disclosure, and corresponding to FIG. 4. FIG. 10 is a view schematically illustrating a third modified example of a first embodiment of the present disclosure, and corresponding to FIG. 2.

Referring to FIGS. 2 and 4 and FIGS. 9 and 10, in a case of the first embodiment, a fourth external electrode 640 disposed to be spaced apart from the first to third external electrodes 610, 620, and 630 may be modified to be further included. In this modified example, the third external electrode 630 may be disposed on the third surface 103 of the body 100 such that both end portions thereof are arranged to extend to each of the fifth and sixth surfaces 105 and 106 of the body 100. The fourth external electrode 640 may be disposed on the fourth surface 104 of the body 100 such that both end portions thereof are arranged to extend to each of the fifth and sixth surfaces 105 and 106 of the body 100. The fourth external electrode 640 may be in contact with and connected to the noise removal portion 500, and may be used as a ground electrode of the coil component 1000 according to this embodiment, together with the third external electrode 630. In this case, the above-described protrusion, and the opening O or the slit may be applied to the fourth external electrode 640 and the insulating layer 400, applied to this modified example, respectively. Unlike FIGS. 9 and 10, the fourth external electrode 640 may not be in contact with and connected to the noise removal portion 500. In this case, the fourth external electrode 640 may be used as a non-contact terminal, and may be connected to a ground of a mounting substrate or the like, or may be connected to a ground of a package, when the coil component according to this modified example is mounted. When the third and fourth external electrodes 630 and 640 are formed on the third and fourth surfaces 103 and 104 of the body 100 by a TWA printing process or the like, a structure of the aforementioned third and fourth external electrodes 630 and 640 may be easily formed.

Although not illustrated, an external insulating layer may be formed in a region, except for regions in which the first to fourth external electrodes 610, 620, 630, and 640 are formed on the first to sixth surfaces 101, 102, 103, 104, 105, and 106 of the body 100, but the scope of the present disclosure is not limited thereto.

Although the above has been described on the assumption that the first and second external electrodes 610 and 620 are arranged on the five surfaces of the body 100, respectively, this is only illustrative. As another example, the external electrodes 610 and 620 may be formed in a form of three-sided electrodes (e.g., the first external electrode 610 may be disposed on the first surface 101 of the body 100, such that both end portions thereof only extend to the fifth and sixth surfaces 105 and 106 of the body 100, respectively), or L-type electrodes (e.g., the first external electrode 610 may be disposed on the first surface 101 of the body 100 to extend to only the sixth surface 106 of the body 100).

Second Embodiment & Modified Example

Figure 11:
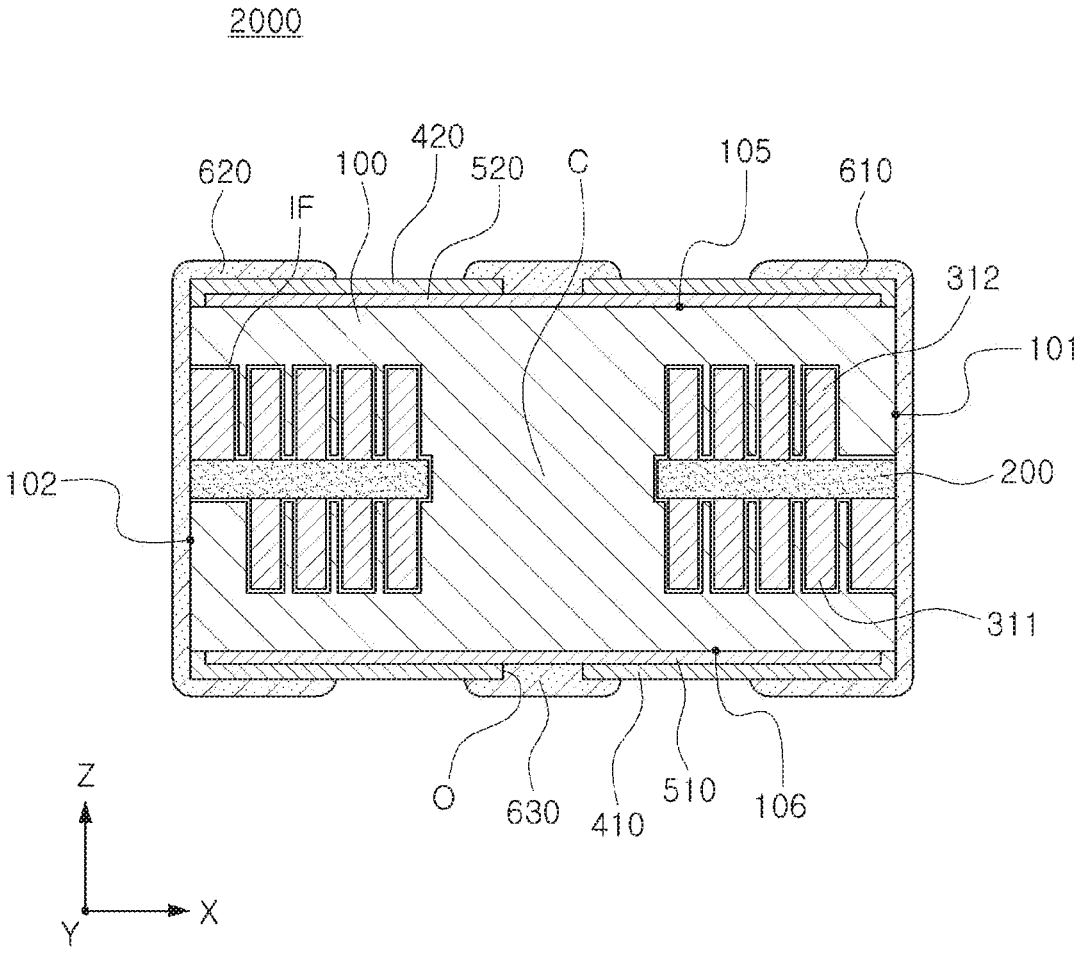
FIG. 11 is a view schematically illustrating a coil component according to a second embodiment of the present disclosure, and corresponding to FIG. 3.
Figure 12:
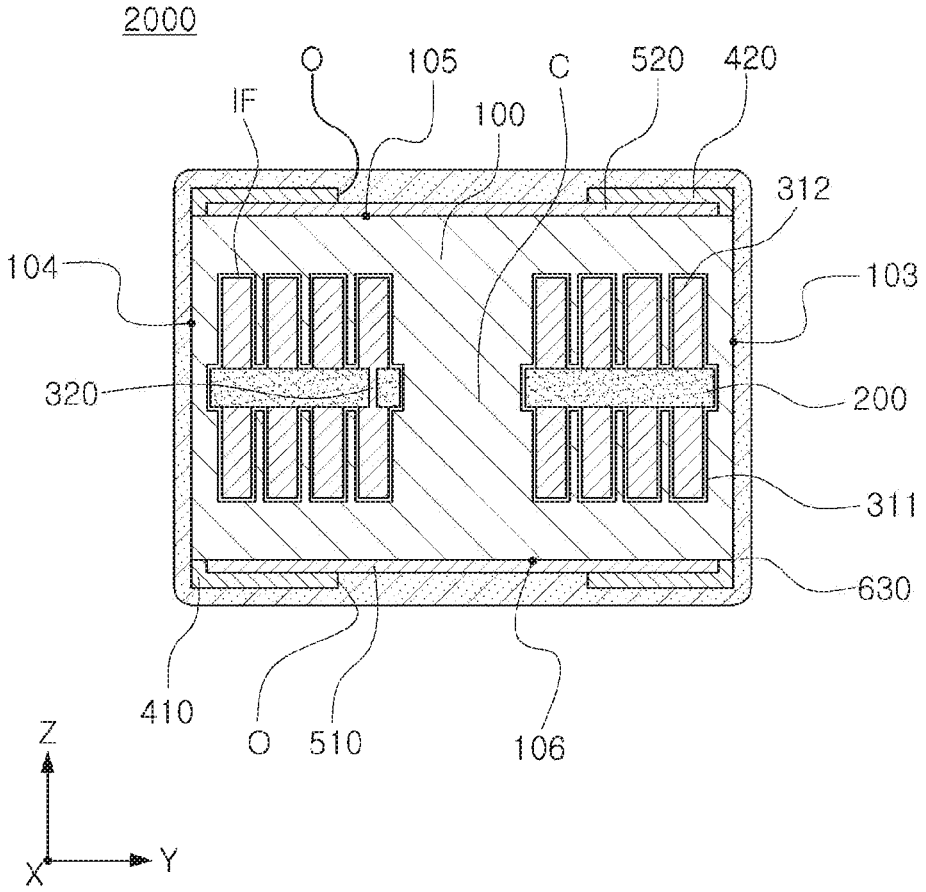
FIG. 12 is a view schematically illustrating a coil component according to a second embodiment of the present disclosure, and corresponding to FIG. 4.

FIG. 11 is a view schematically illustrating a coil component according to a second embodiment of the present disclosure, and corresponding to FIG. 3. FIG. 12 is a view schematically illustrating a coil component according to a second embodiment of the present disclosure, and corresponding to FIG. 4.

Referring to FIGS. 1 to 5 and FIGS. 11 and 12, when a coil component 2000 according to this embodiment is compared to the coil component 1000 according to the first embodiment of the present disclosure, structures of noise removal portions 510 and 520 and insulating layers 410 and 420 may be differently provided. Therefore, in describing this embodiment, only the structures of the noise removal portions 510 and 520 and the insulating layers 410 and 420, different from the first embodiment of the present disclosure, will be described. For the remainder of the configuration of this embodiment, the description of the first embodiment of the present disclosure and the description of the modified example of the first embodiment may be applied as they are.

Referring to FIGS. 11 and 12, the noise removal portions 510 and 520 applied to the coil component 2000 according to this embodiment may include a first noise removal portion 510 disposed to contact the sixth surface 106 of the body 100, and a second noise removal portion 520 disposed to contact the fifth surface 105 of the body 100. The insulating layers 410 and 420 may include a first insulating layer 410 disposed on the first noise removal portion 510, and a second insulating layer 420 disposed on the second noise removal portion 520. The first and second external electrodes 610 and 620 may extend respectively to a portion of the fifth and sixth surfaces 105 and 106 of the body 100, to be respectively capacitively-coupled to the first noise removal portion 510 on the sixth surface 106 of the body 100, and to be respectively capacitively-coupled to the second noise removal portion 520 on the fifth surface 105 of the body 100. For example, in this embodiment, based on the direction of FIG. 11, capacitive-coupling between each of the noise removal portion 500 and the first and second external electrodes 610 and 620, described in the first embodiment of the present disclosure, may be formed on each of the upper and lower surfaces of the body 100. In this embodiment, capacitive-coupling between each of the first and second external electrodes 610 and 620 and the noise removal portions 510 and 520 may increase, to improve an effect of removing high frequency noise.

Unlike the first embodiment of the present disclosure, the third external electrode 630 may be continuously formed on the third to sixth surfaces 103, 104, 105, and 106 of the body 100 to have a rectangular cross-sectional shape. In this case, the protrusion and the opening described in the first embodiment of the present disclosure may be also formed in the second insulating layer 420 and the third external electrode 630, disposed on the fifth surface 105 of the body 100. That is, the third external electrode 630 may be formed in a closed-loop shape to surround the body 100, and may be connected to the first and second noise removal portions 510 and 520, disposed on opposing surfaces (e.g., the fifth and sixth surfaces 105 and 106) of the body 100, through each opening O defined on the first and second insulating layers 410 and 420. Such a closed-loop shape of a third external electrode may be applied to another exemplary embodiment of a coil component where the first and second noise removal portions 510 and 520 are disposed on side surfaces of the body 100 (e.g., the third and fourth surfaces 103 and 104).

In this embodiment, the fourth external electrode described in the third modified example of the first embodiment of the present disclosure may be modified to be further included. In this case, the third external electrode 630 may be in contact with the first noise removal portion 510 and/or the second noise removal portion 520, and the fourth external electrode may be in contact with the first noise removal portion 510 and/or the second noise removal portion 520.

Third Embodiment & Modified Example

Figure 13:
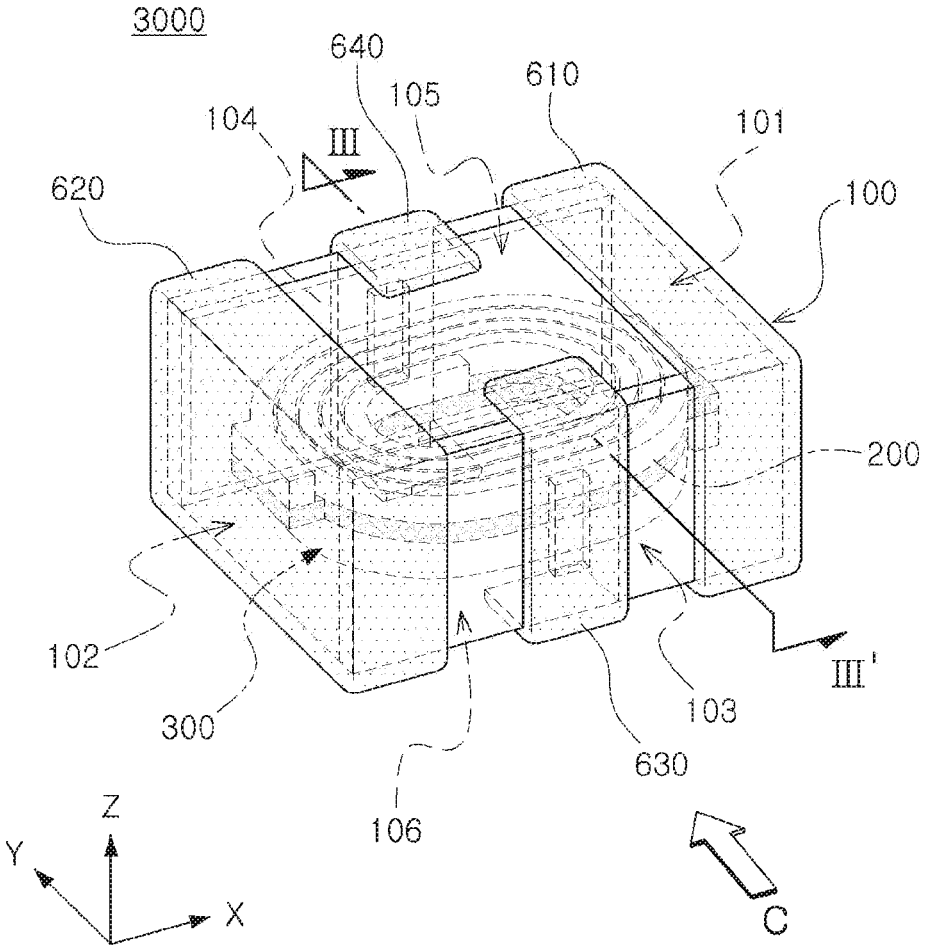
FIG. 13 is a view schematically illustrating a coil component according to a third embodiment of the present disclosure.
Figure 14:
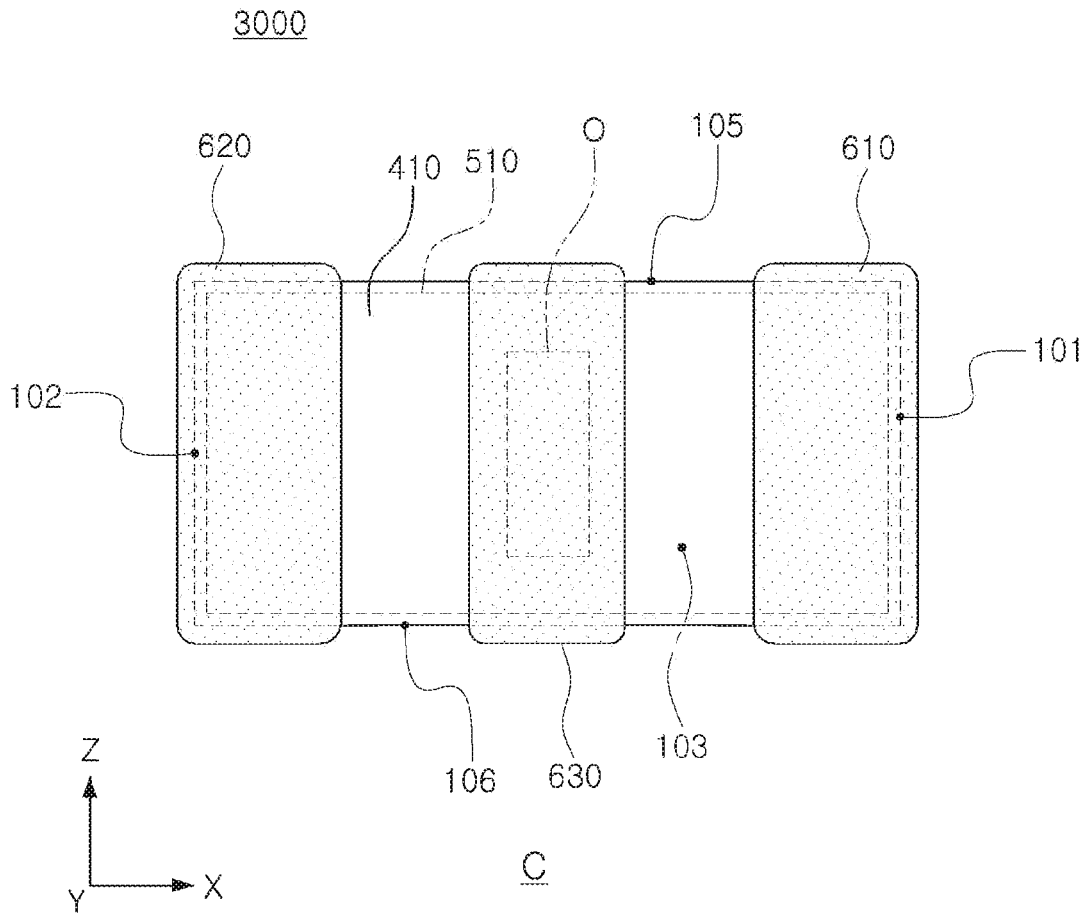
FIG. 14 is a schematic view of FIG. 13, when viewed in a C direction.
Figure 15:
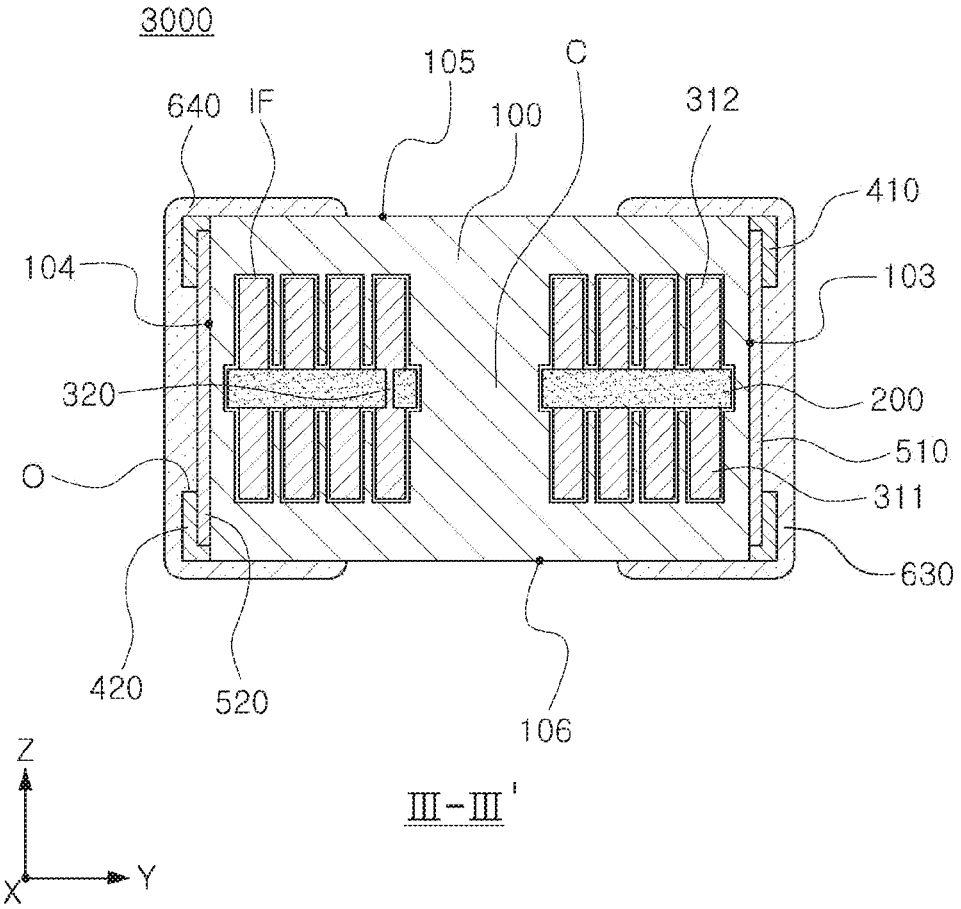
FIG. 15 is a view illustrating a cross-section taken along line III-III' of FIG. 13.

FIG. 13 is a view schematically illustrating a coil component according to a third embodiment of the present disclosure. FIG. 14 is a schematic view of FIG. 13, when viewed in a C direction. FIG. 15 is a view illustrating a cross-section taken along line of FIG. 13.

Referring to FIGS. 1 to 5 and FIGS. 13 to 15, when a coil component 3000 according to this embodiment is compared to the coil component 1000 according to the first embodiment of the present disclosure, the noise removal portions 510 and 520 and the insulating layers 410 and 420 may be differently provided. Therefore, in describing this embodiment, only structures of the noise removal portions 510 and 520 and the insulating layers 410 and 420, different from the first embodiment of the present disclosure, will be described. For the rest of the configuration of this embodiment, the description of the first embodiment of the present disclosure and the description of the modified example of the first embodiment may be applied as they are.

Referring to FIGS. 13 to 15, a noise removal portion applied to the coil component 3000 according to this embodiment may be disposed to contact at least one of both side surfaces of the body. In addition, an insulating layer may be disposed on a surface of the body on which the noise removal portion is disposed. Hereinafter, it will be described on the assumption that the noise removal portions 510 and 520 and the insulating layers 410 and 420 are formed on the third and fourth surfaces of the body 100, respectively, but this is only illustrative. Therefore, the fact that the noise removal portions 510 and 520 is disposed on only one of the third and fourth surfaces 103 and 104 of the body 100 is not excluded from the scope of this embodiment.

In this embodiment, the noise removal portions 510 and 520 may include a first noise removal portion 510 disposed to contact the third surface 103 of the body 100, and a second noise removal portion 520 disposed to contact the fourth surface 104 of the body 100. The insulating layers 410 and 420 may include a first insulating layer 410 disposed on the first noise removal portion 510, and a second insulating layer 420 disposed on the second noise removal portion 520. The first and second external electrodes 610 and 620 may extend respectively to a portion of the third and fourth surfaces 103 and 104 of the body 100, to be respectively capacitively-coupled to the first noise removal portion 510 on the third surface 103 of the body 100, and to be respectively capacitively-coupled to the second noise removal portion 520 on the fourth surface 104 of the body 100.

Although FIGS. 13 and 15 illustrate that this embodiment includes the fourth external electrode 640, the scope of this embodiment is not limited thereto. The fourth external electrode 640 may be omitted in this embodiment. In addition, the third external electrode 630 alone may be modified to contact each of the first and second noise removal portions 510 and 520.

In this embodiment, the noise removal portions 510 and 520 described in this embodiment may be modified to combine the noise removal portion 500 described in the first embodiment of the present disclosure, and/or the noise removal portions 510 and 520 described in the second embodiment of the present disclosure.

According to an embodiment of the present disclosure, high frequency noise may be easily removed.

While example embodiments have been illustrated and described above, it will be apparent to those skilled in the art that modified examples and variations could be made without departing from the scope of the present disclosure as defined by the appended claims.

What is claimed is:

1. A coil component comprising:

a body;

a coil portion disposed inside the body;

a noise removal portion disposed to contact a surface of the body and arranged inward of an entire outer edge of the surface;

an insulating layer disposed on the noise removal portion;

first and second external electrodes each connected to the coil portion and disposed on the insulating layer to overlap the noise removal portion; and a third external electrode disposed to be spaced apart from the first and second external electrodes and contacting the noise removal portion, wherein the third external electrode penetrates through the insulating layer to contact the noise removal portion such that all side surfaces of the third external electrode contact the insulating layer.

2. The coil component according to claim 1, further comprising a fourth external electrode disposed to be spaced apart from the first to third external electrodes.

3. The coil component according to claim 2, wherein the fourth external electrode is in contact with the noise removal portion.

4. The coil component according to claim 1, wherein the body has a first surface and a second surface opposing each other in a thickness direction of the body, both end surfaces each connecting the first surface to the second surface of the body and opposing each other in a longitudinal direction of the body, and both side surfaces each connecting the both end surfaces of the body to each other and opposing each other in a width direction of the body, wherein the noise removal portion is disposed to contact the first surface of the body, the first and second external electrodes are disposed to be spaced apart from each other on the first surface of the body, and each of the first and second external electrodes overlaps the noise removal portion in the thickness direction, and the third external electrode is disposed to be spaced apart from the first and second external electrodes on the first surface of the body.

5. The coil component according to claim 4, wherein the first and second external electrodes extend onto the both end surfaces of the body from the first surface of the body, and the noise removal portion is disposed to be spaced apart from edges at which the first surface of the body respectively meets the both end surfaces of the body and the both side surfaces of the body.

6. The coil component according to claim 5, wherein the insulating layer covers a side surface of the noise removal portion in the width direction.

7. The coil component according to claim 5, wherein the noise removal portion comprises a first noise removal portion disposed to contact the first surface of the body, and a second noise removal portion disposed to contact the second surface of the body, the insulating layer comprises a first insulating layer disposed on the first noise removal portion, and a second insulating layer disposed on the second noise removal portion, the first and second external electrodes further extend from the both end surfaces of the body onto the second surface of the body, and each of the first and second external electrodes overlaps the first and second noise removal portions in the thickness direction.

8. The coil component according to claim 1, wherein the body has a first surface and a second surface opposing each other in a thickness direction of the body, both end surfaces each connecting the first surface to the second surface of the body and opposing each other in a longitudinal direction of the body, and both side surfaces each connecting the both end surfaces of the body to each other and opposing each other in a width direction of the body, wherein the noise removal portion is disposed to contact at least one of the both side surfaces of the body, and the first and second external electrodes are disposed on the both end surfaces of the body, respectively, and each extend onto at least one of the both side surfaces of the body to overlap the noise removal portion in the width direction.

9. The coil component according to claim 8, wherein the insulating layer is arranged between the noise removal portion and each of the first and second external electrodes in the width direction.

10. The coil component according to claim 1, wherein the noise removal portion includes a conductor.

11. The coil component according to claim 1, wherein the noise removal portion comprises a seed layer disposed on the surface of the body, and a plating layer disposed on the seed layer.

12. A coil component comprising:

a body;

a coil portion disposed inside the body;

a noise removal portion disposed on a surface of the body in a first direction and contacting said surface;

an insulating layer disposed on the noise removal portion in the first direction;

first and second external electrodes respectively connected to opposing ends of the coil portion; and a third external electrode disposed to be spaced apart from the first and second external electrodes and contacting the noise removal portion, wherein the insulating layer is arranged between the noise removal portion and each of the first and second external electrodes in the first direction, and wherein the insulating layer includes a first opening through which the third external electrode extends such that all side surfaces of the third external electrode contact the insulating layer, and through which the third external electrode is connected to the noise removal portion.

13. The coil component according to claim 12, wherein the noise removal portion overlaps each of first and second external electrodes in the first direction.

14. The coil component according to claim 12, further comprising a fourth external electrode disposed to be spaced apart from the first to third external electrodes, and contacting the noise removal portion.

15. The coil component according to claim 14, wherein the insulating layer further includes a second opening through which the fourth external electrode is connected to the noise removal portion.

16. The coil component according to claim 12, wherein the first and second external electrodes are disposed on both end surfaces of the body to be connected to the opposing ends of the coil portion, respectively, and each extend onto said surface of the body.

17. The coil component according to claim 16, wherein the noise removal portion comprises a first noise removal portion disposed to contact said surface of the body, and a second noise removal portion disposed to contact an opposing surface of said surface, and the insulating layer comprises a first insulating layer disposed on the first noise removal portion, and a second insulating layer disposed on the second noise removal portion, and each of the first and second external electrodes overlaps the first and second noise removal portions in the first direction.

18. The coil component according to claim 17, wherein the insulating layer further includes a second opening, wherein the third external electrode is formed in a closed-loop shape to surround the body, and is connected to the first and second noise removal portions, disposed on opposing surfaces of the body, through the first and second openings, respectively.

* * * * *